US008801499B2

(12) United States Patent
Yoshizawa et al.

(10) Patent No.: US 8,801,499 B2
(45) Date of Patent: Aug. 12, 2014

(54) BLASTING APPARATUS AND METHOD FOR BLAST PROCESSING

(75) Inventors: Takenori Yoshizawa, Osaka (JP); Kazuteru Sawai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 524 days.

(21) Appl. No.: 13/265,337

(22) PCT Filed: Mar. 11, 2010

(86) PCT No.: PCT/JP2010/054077

§ 371 (c)(1),
(2), (4) Date: Oct. 20, 2011

(87) PCT Pub. No.: WO2010/122851

PCT Pub. Date: Oct. 28, 2010

(65) Prior Publication Data

US 2012/0058711 A1 Mar. 8, 2012

(30) Foreign Application Priority Data

Apr. 21, 2009 (JP) ..... 2009-102809

(51) Int. Cl.
*B24B 1/00* (2006.01)
*B24B 55/06* (2006.01)

(52) U.S. Cl.
USPC ..... 451/38; 451/87; 451/89; 451/90; 451/456

(58) Field of Classification Search
USPC ..... 451/38, 39, 40, 75, 87, 89, 90, 102, 451/344, 354, 451, 456
See application file for complete search history.

(56) References Cited

U.S. PATENT DOCUMENTS

| | | | | | |
|---|---|---|---|---|---|
| 2,846,822 | A | * | 8/1958 | Steffen | 451/91 |
| 3,186,132 | A | * | 6/1965 | Duncan et al. | 451/38 |
| 3,545,996 | A | * | 12/1970 | Duncan | 427/198 |
| 3,715,838 | A | * | 2/1973 | Young et al. | 451/87 |
| 3,906,673 | A | * | 9/1975 | Goto et al. | 451/92 |

(Continued)

FOREIGN PATENT DOCUMENTS

| | | | |
|---|---|---|---|
| JP | 8-216024 | A | 8/1996 |
| JP | 2001-357777 | A | 12/2001 |
| JP | 2005-334979 | A | 12/2005 |
| JP | 2006-326819 | A | 12/2006 |

OTHER PUBLICATIONS

International Search Report, dated Jun. 8, 2010, issued in PCT/JP2010/054077.

*Primary Examiner* — Eileen P. Morgan
(74) *Attorney, Agent, or Firm* — Birch, Stewart, Kolasch & Birch, LLP

(57) ABSTRACT

A blasting apparatus capable of increasing suction power to collect an abrasive without exerting any influence on processing of a work surface with the abrasive. The apparatus includes a blasting nozzle (2) blasting an abrasive (100) on a surface (200*a*) of work (200), a cover (10) including a surface (10*a*) for airflow alignment parallel to the work surface and a blast hole (10*b*) through which the abrasive from the nozzle passes, a nozzle case (9) including the cover and surrounding the nozzle, and a collecting case (11) covering an outer surface of the nozzle case and including a collecting passage (11*c*) disposed around the nozzle case, from the passage, the abrasive being collected by suction, wherein the apparatus collects the abrasive that is blasted from the nozzle and strikes the work surface from the passage through a clearance (13) provided between the airflow-alignment surface and the work surface.

8 Claims, 2 Drawing Sheets

(56) References Cited

U.S. PATENT DOCUMENTS

| | | | | | |
|---|---|---|---|---|---|
| 4,045,915 | A | * | 9/1977 | Gilbert et al. | 451/90 |
| 4,064,661 | A | * | 12/1977 | Maeda | 451/87 |
| 4,375,740 | A | * | 3/1983 | Brown | 451/88 |
| 4,563,840 | A | * | 1/1986 | Urakami | 451/102 |
| 4,600,149 | A | * | 7/1986 | Wakatsuki | 239/120 |
| 4,624,080 | A | * | 11/1986 | Jakobsson | 451/87 |
| 4,984,396 | A | * | 1/1991 | Urakami | 451/87 |
| 4,993,200 | A | * | 2/1991 | Morioka et al. | 451/88 |
| 5,018,319 | A | * | 5/1991 | Allard | 451/87 |
| 5,181,348 | A | * | 1/1993 | Roemmele et al. | 451/75 |
| 5,667,429 | A | * | 9/1997 | Uchida et al. | 451/87 |
| 5,667,430 | A | * | 9/1997 | McPhee et al. | 451/87 |
| 5,709,590 | A | * | 1/1998 | McPhee et al. | 451/87 |
| 5,833,521 | A | * | 11/1998 | McPhee et al. | 451/87 |
| 5,957,761 | A | * | 9/1999 | Miller et al. | 451/92 |
| 6,012,975 | A | * | 1/2000 | Jager | 451/87 |
| 6,273,154 | B1 | * | 8/2001 | Laug | 141/97 |
| 6,390,898 | B1 | * | 5/2002 | Pieper | 451/75 |
| 6,997,780 | B2 | * | 2/2006 | Pieper | 451/38 |
| 7,182,671 | B1 | * | 2/2007 | Shimizu et al. | 451/8 |
| 7,226,343 | B2 | * | 6/2007 | Bohler | 451/90 |
| 2001/0051493 | A1 | * | 12/2001 | Kelton et al. | 451/36 |
| 2004/0053561 | A1 | * | 3/2004 | Pieper | 451/38 |
| 2006/0252357 | A1 | * | 11/2006 | Bohler | 451/90 |
| 2010/0122719 | A1 | * | 5/2010 | Mase et al. | 136/244 |
| 2011/0065363 | A1 | * | 3/2011 | Kuroiwa et al. | 451/38 |
| 2012/0186520 | A1 | * | 7/2012 | Hill | 118/713 |
| 2012/0301643 | A1 | * | 11/2012 | Aadland et al. | 428/34.1 |

* cited by examiner

BLASTING APPARATUS AND METHOD FOR BLAST PROCESSING

TECHNICAL FIELD

The present invention relates to an apparatus and a method for processing a surface of work, and specifically relates to a blasting apparatus and a method for blast processing, with which processing is performed such that a depressed portion is formed on a surface of work such as a glass substrate by the use of a blast of an abrasive.

BACKGROUND ART

Conventionally, a glass substrate having a thickness of about 0.7 mm is generally used for a flat-screen display panel such as a liquid crystal display panel and a plasma display panel. The glass substrate of this type is desired to have a flat surface and an excellent light transmission property.

The glass substrate of this type could sometimes develop, during production, a defect such as a tiny flaw and a pore of air bubble on its surface, or a defect such as an air bubble and a foreign substance that are trapped inside of the glass substrate. If there exists such a defect, a problem that causes a scattering of light arises. In order to solve this problem, the portion where the defect exists is usually scraped off the glass substrate, and the depressed portion thus made is filled with a transparent resin and then planarized.

The defect is scraped off the glass substrate in a method using a blasting apparatus for processing the glass substrate, in which the glass substrate is struck with a high-speed blast of an abrasive (also referred to a shot or an abrasive grain) such as alumina powder, silicon carbide powder, glass beads and very small steel balls, together with fluid such as air, and the striking power causes minute destruction to the glass substrate to process the glass substrate.

FIG. 2 is a cross-sectional view showing a schematic configuration of a conventional blasting apparatus. A blasting apparatus 21 includes a blasting nozzle 22 arranged to blast an abrasive 100, and a nozzle case 23 arranged to surround the blasting nozzle 22 as shown in FIG. 2.

A suction hose 24 is connected to a posterior portion of a side wall 23*a* of the nozzle case 23. The suction hose 24 is arranged to collect the abrasive 100 that is blasted from the blasting nozzle 22 and used for blast processing in forming a depressed portion 200*b* on a surface 200*a* of a glass substrate 200, and thus the abrasive 100 is prevented from shattering around.

The abrasive 100 is collected because, while shattering around, it worsens a working environment and exert a harmful influence such as health damage on workers.

In this case, an abrasive having a grain diameter of several micrometers is used as the abrasive 100 blasted from the blasting nozzle 22. The depressed portion 200*b* that is formed by scraping a defect of the glass substrate 200 in blast processing is several millimeters in diameter, and several tens to several hundreds micrometers in depth. The prior art to the present invention is described in PTL 1.

CITATION LIST

Patent Literature

PTL 1: JP H08-216024

SUMMARY OF INVENTION

Technical Problem

However, having the configuration to suck out air in the nozzle case 23 as described above, the blasting apparatus 21 is not capable of sufficiently sucking the abrasive 100 having the grain diameter of several micrometers, which is used for fine processing informing the depressed portion 200*b* that is several millimeters in diameter on the surface 200*a* of the glass substrate 200, while the blasting apparatus 21 is capable of sufficiently sucking an abrasive having a grain diameter of several hundreds micrometers to several millimeters, which is used for sand blast processing in roughening the surface of stone, concrete or metal.

In order to solve this problem, the suction power is increased so that the abrasive 100 having the small grain diameter may be collected by suction. However, a problem is caused that the blast processing is not sufficiently performed because the striking power of strikes of the abrasive 100 on the surface 200*a* of the glass substrate 200 diminishes due to the configuration of the blasting apparatus 21 that the abrasive 100 is sucked in a direction opposite to a direction in which the abrasive 100 is blasted as shown in FIG. 2.

Increasing the blasting power of the blasting nozzle 22 to blast the abrasive 100 may counter the increased suction power; however, another problem is caused that processing accuracy is deteriorated.

The processing in a depth direction should be within an accuracy of several micrometers to several tens micrometers in forming the depressed portion 200*b* on the surface 200*a* of the glass substrate 200 having a thickness of about 0.7 mm by scraping a defect as described above of the glass substrate 200. Thus, if the blasting power is increased in addition to the suction power, the processing accuracy in the depth direction cannot be obtained.

In order to overcome the problems described above, preferred embodiments of the present invention provide a blasting apparatus and a method for blast processing that are capable of increasing suction power to collect an abrasive, without exerting any influence on processing of a work surface with an abrasive.

Solution to Problem

Preferred embodiments of the present invention provide a blasting apparatus that includes a blasting nozzle arranged to blast an abrasive on a surface of work, a cover including a surface for airflow alignment that is parallel to the work surface and a blast hole through which the abrasive blasted from the blasting nozzle passes, a nozzle case that includes the cover and arranged to surround the blasting nozzle, and a collecting case that is arranged to cover an outer surface of the nozzle case, and includes a collecting passage disposed around the nozzle case, from the collecting passage, the abrasive being collected by suction, wherein the blasting apparatus is arranged to collect the abrasive, which is blasted from the blasting nozzle and strikes the work surface, from the collecting passage through a clearance provided between the surface for airflow alignment of the cover and the work surface.

In another aspect of the present invention, a method for blast processing a surface of work with an abrasive blasted from a blasting nozzle includes the steps of blasting the abrasive from the blasting nozzle on the work surface through a blast hole of a cover of a nozzle case that surrounds the blasting nozzle, striking the work surface with the abrasive, and collecting by suction the abrasive, which has passed through a clearance provided between a surface for airflow alignment that is provided to the cover and parallel to the work surface, and the work surface, from a collecting passage disposed around the nozzle case and provided to a collecting case that covers an outer surface of the nozzle case.

The blasting apparatus and the method for blast processing having the configurations described above are capable of more abating a scattering force of the abrasive (a force of the abrasive scattering around), which is blasted from the blasting nozzle, passes through the blast hole of the cover and strikes the work surface, that is, the abrasive used for blast processing the work surface, as the abrasive scatters around farther through the clearance provided between the surface for airflow alignment of the cover and the work surface, and capable of collecting by suction the abrasive from the collecting passage provided to the collecting case when the scattering force of the abrasive is abated.

To be specific, the configuration that a direction in which the abrasive used for blast processing the work surface is sucked is radial and perpendicular to a direction in which the abrasive is blasted prevents the suction power from influencing the striking power of strikes of the abrasive on the work surface even when the suction power from the collecting passage is increased so that the abrasive, even having a small grain diameter, maybe sufficiently sucked. Thus, the blasting apparatus and the method for blast processing are capable of maintaining blast processing accuracy, and collecting the abrasive while preventing the abrasive from scattering around.

It is preferable that the collecting case includes an open end that is flush with the surface for airflow alignment of the cover. This configuration allows the abrasive to be sufficiently sucked and collected from the collecting passage provided to the collecting case even when the surface for airflow alignment of the cover is brought closer to the work surface, that is, even when the clearance provided between the surface for airflow alignment of the cover and the work surface is narrowed.

It is preferable that the nozzle case has a conical shape such that a side wall of the nozzle case expands toward a direction in which the abrasive is blasted, and the collecting case has a conical shape such that a side wall of the collecting case expands toward the direction in which the abrasive is blasted. Allowing the surface for airflow alignment of the cover to obtain a size enough to abate the scattering force of the abrasive that is used for blast processing the work surface and scatters, the configuration contributes to a downsizing of the nozzle case and the collecting case.

It is preferable that the method for blast processing further includes the step of forming a depressed portion on the work surface by the use of the blast of the abrasive from the blasting nozzle. It is preferable that the work defines a glass substrate used for a display panel such as a liquid crystal display panel. These configurations allow the depressed portion to be formed easily with precision such that a defect such as a tiny flaw and a pore of air bubble on its surface or a defect such as an air bubble and a foreign substance that are trapped inside of the glass substrate can be scraped off the glass substrate, which improves a workability of repairing the defect of the glass substrate.

Advantageous Effects of Invention

According to the blasting apparatus and the method for blast processing according to the preferred embodiments of the present invention, a scattering force of the abrasive (a force of the abrasive scattering around) used for blast processing the work surface can be abated more as the abrasive scatters farther in the clearance provided between the surface for airflow alignment of the cover and the work surface, and the abrasive can be collected by suction from the collecting passage provided to the collecting case. Thus, the blasting apparatus and the method for blast processing are capable of preventing the suction power from influencing the striking power of strikes of the abrasive on the work surface even when the suction power from the collecting passage is increased so that the abrasive, even having a small grain diameter, may be sufficiently sucked. In addition, the blasting apparatus and the method for blast processing are capable of maintaining blast processing accuracy, and collecting the abrasive while preventing the abrasive from scattering around.

DESCRIPTION OF EMBODIMENTS

A detailed description of a blasting apparatus and a method for blast processing according to preferred embodiments of the present invention will now be provided with reference to the accompanying drawings.

Figure 1:
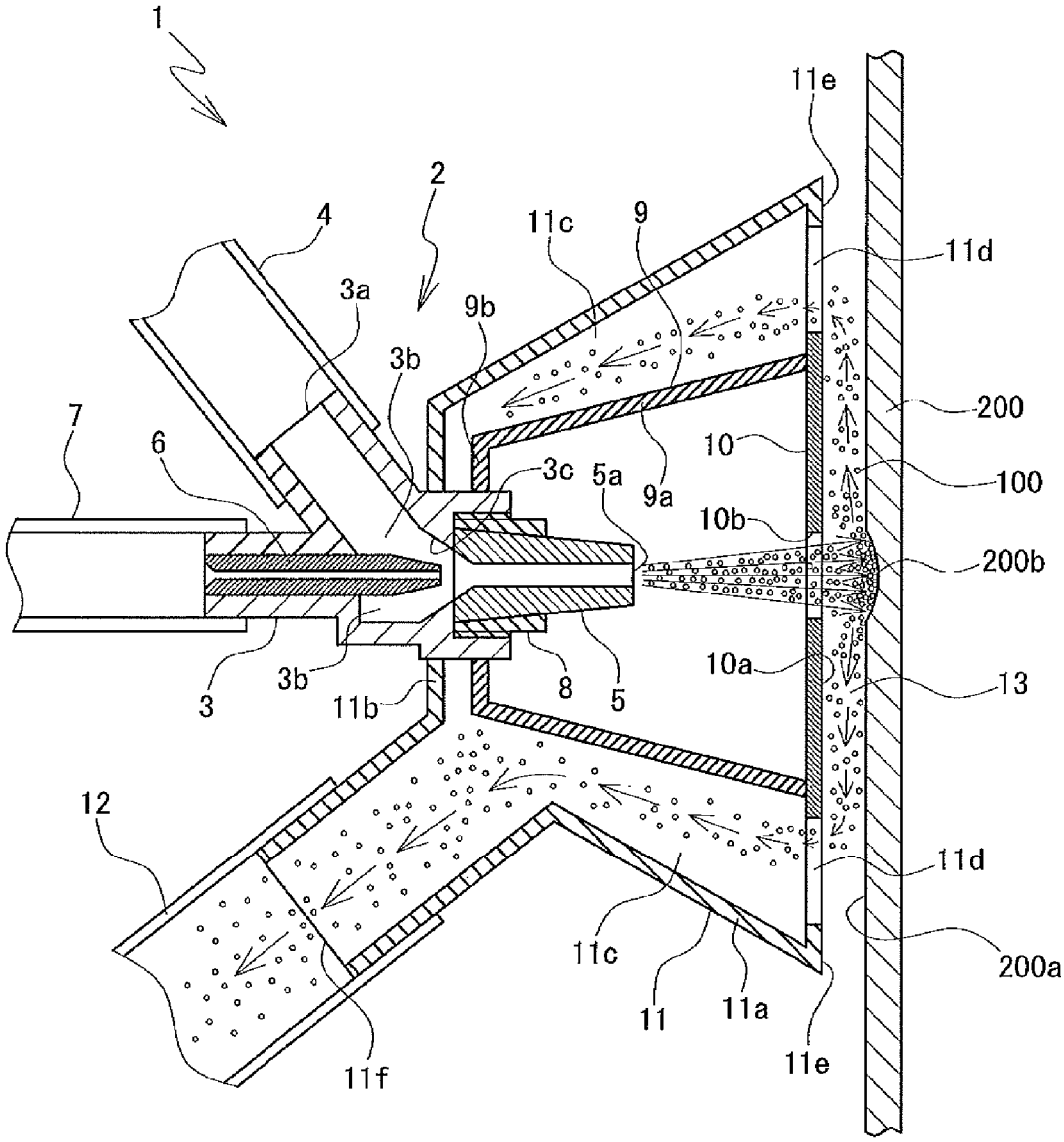
FIG. 1 is a cross-sectional view showing a schematic configuration of a blasting apparatus according to a first preferred embodiment of the present invention.

FIG. 1 is a cross-sectional view showing a schematic configuration of a blasting apparatus 1 according to one of the preferred embodiments of the present invention. The blasting apparatus 1 includes a blasting nozzle 2. The blasting nozzle 2 includes a nozzle body 3 that includes a port 3*a* for abrasive feeding and a chamber 3*b* for abrasive guiding that communicates with the port 3*a* and has the shape of a cylindrical container, where an abrasive 100 is guided to the chamber 3*b* via a hose 4 for abrasive supply from a tank for abrasive supply (not shown) as shown in FIG. 1. The chamber 3*b* includes a conical inner surface 3*c* disposed at the front end of the chamber 3*b*.

The front end of a pipe 6 for air blasting that is inserted from behind the chamber 3*b* is disposed inside the conical inner surface 3*c*. The pipe 6 communicates with a source for compressed-air supply (not shown) via a hose 7 for compressed-air supply. Compressed air at a relatively high pressure is sent to the pipe 6, and airflow is blasted from the front end of the pipe 6.

A nozzle 5 is provided to the front end of the nozzle body 3, and disposed in front of the pipe 6 in the direction in which the pipe 6 blasts air. The nozzle 5 communicates with the chamber 3*b* through the conical inner surface 3*c*, and is arranged to blast a flow of blasting abrasive from a port 5*a* for abrasive blast.

A nozzle holder 8 has a cylindrical shape, and includes a tapered portion on its inner surface. The tapered portion provided on the inner surface of the nozzle holder 8 is fitted onto a tapered portion provided on the outer surface of the nozzle 5, and the nozzle 5 is fastened to the front end of the nozzle body 3 with a screw portion provided on the outer surface of the nozzle holder 8, whereby the nozzle 5 is secured to the nozzle body 3.

In the blasting nozzle 2 having this configuration, negative pressure builds up in the chamber 3*b* when the compressed air is blasted from the front end of the pipe 6 toward the nozzle 5, so that the abrasive 100 in the tank for abrasive supply (not shown) is sucked into the chamber 3*b* via the hose 4.

Then, the abrasive 100 in the chamber 3*b* is guided to a ring-shaped clearance between the conical inner surface 3*c* and the pipe 6. Riding the airflow blasted from the pipe 6, the abrasive 100 is blasted toward the outside from the port 5*a* at the front end of the nozzle 5 while scattering conically.

The outer surface of the blasting nozzle 2 having this configuration is surrounded with a nozzle case 9. The nozzle case 9 has a conical shape such that a side wall 9*a* of the nozzle case 9 expands by degrees toward a direction in which the abrasive 100 is blasted. A posterior wall 9*b* of the nozzle case 9 is disposed so as to close a posterior portion of the nozzle case 9 and secured to the nozzle body 3.

A cover 10 having a disk shape is disposed in front of the nozzle case 9 (on the side toward which the abrasive 100 is blasted) so as to close an opening portion of the nozzle case 9. The cover 10 includes a surface 10*a* for airflow alignment having a circular shape on the side toward which the abrasive 100 is blasted. The cover 10 includes a blast hole 10*b* in its center, through which the abrasive 100 blasted from the nozzle 5 passes.

The surface 10*a* of the cover 10 has a configuration parallel to a surface 200*a* of a glass substrate 200 that is to be blast working as shown in FIG. 1, and is disposed apart from the surface 200*a* of the glass substrate 200 at a given distance during the blast processing.

The outer surface of the nozzle case 9 is surrounded with a collecting case 11. The collecting case 11 has a conical shape such that a side wall 11*a* of the collecting case 11 expands by degrees toward a direction in which the abrasive 100 is blasted. A posterior wall 11*b* of the collecting case 11 is disposed so as to close a posterior portion of the collecting case 11 and secured to the nozzle body 3.

The clearance between the inner surface of the side wall 11*a* of the collecting case 11 and the outer surface of the side wall 9*a* of the nozzle case 9 is defined as a collecting passage 11*c* arranged to collect the abrasive 100. A collecting port 11*d* having a ring shape is provided at the front end of the collecting passage 11*c*. In this configuration, an open end 11*e* that defines the front end of the collecting case 11 (i.e., the collecting port 11*d*) has a configuration substantially flush with the surface 10*a* of the cover 10.

The collecting passage 11*c* communicates with a suction hose 12 via a suction port 11*f* that opens behind the side wall 11*a* of the collecting case 11. The suction hose 12 is connected to a suction equipment (not shown), and arranged to suck the abrasive 100 in the collecting passage 11*c*.

An abrasive having a grain diameter of several micrometers is used as the abrasive 100 blasted from the blasting nozzle 5. A depressed portion 200*b* having a circular shape in a plan view is formed by scraping a defect (e.g., a tiny flaw and a pore of air bubble on the surface 200*a* or an air bubble and a foreign substance that are trapped inside of the glass substrate 200) of the glass substrate 200 in blast processing. Thus-formed depressed portion 200*b* is several millimeters in diameter, and several tens to several hundreds micrometers in depth.

In accordance with the size of the depressed portion 200*b*, the blast hole 10*b* provided in the center of the cover 10 is made to have a size such that the blasted abrasive 100 is not brought into contact with the blast hole 10*b*, which is several millimeters in diameter. A transparent glass substrate having a thickness of about 0.7 mm that is generally used for a flat-screen display panel such as a liquid crystal display panel and a plasma display panel is used as the glass substrate 200.

As shown in FIG. 1, a scattering force of the abrasive 100 (a force of the abrasive 100 scattering around), which is blasted from the blasting nozzle 2, passes through the blast hole 10*b* of the cover 10 and strikes the surface 200*a* of the glass substrate 200, that is, the abrasive 100 used for blast processing in which the depressed portion 200*b* is formed by striking the surface 200*a* of the glass substrate 200 with the abrasive 100, is abated more as the abrasive 100 farther scatters around radially from a position on the surface 200*a* of the glass substrate 20 where the abrasive 100 strikes through a clearance 13 provided between the surface 10*a* of the cover 10 and the surface 200*a* of the glass substrate 200.

The suction from the ring-shaped collecting port 11*d* produces airflow, which radially spreads centering around the position on the glass substrate 200 where the abrasive 100 strikes, in the clearance 13 provided between the surface 10*a* of the cover 10 and the surface 200*a* of the glass substrate 200. Thus, riding the airflow, the abrasive 100 that has struck is guided to the collecting port 11*d*.

Consequently, the abrasive 100*a*, of which the scattering force is abated by passing through the clearance 13 where the airflow is produced, can be easily collected by suction from the collecting port 11*d*. During the collection, glass wastes (not shown) that are scraped off the glass substrates 200 by the strikes of the abrasive 100 are collected by suction together with the abrasive 100 from the collecting port 11*d*.

According to the blasting apparatus 1 having this configuration, the suction power can be prevented from influencing the striking power of strikes of the abrasive 100 on the surface 200*a* of the glass substrate 200 even when the suction power from the collecting passage 11*c* is increased so that the abrasive 100, even having a small grain diameter such as several micrometers, may be sufficiently sucked.

To be specific, the configuration that a direction in which the abrasive 100 used for blast processing the surface 200*a* of the glass substrate 200 is sucked is substantially perpendicular to a direction in which the abrasive 100 is blasted, and the direction in which the abrasive 100 is sucked is made radial by the clearance 13 prevents the suction power from influencing the striking power of strikes of the abrasive 100 on the surface 200*a* of the glass substrate 200 even when the suction power from the collecting passage 11*c* is increased so that the abrasive 100, even having a small grain diameter, may be sufficiently sucked.

Figure 2:
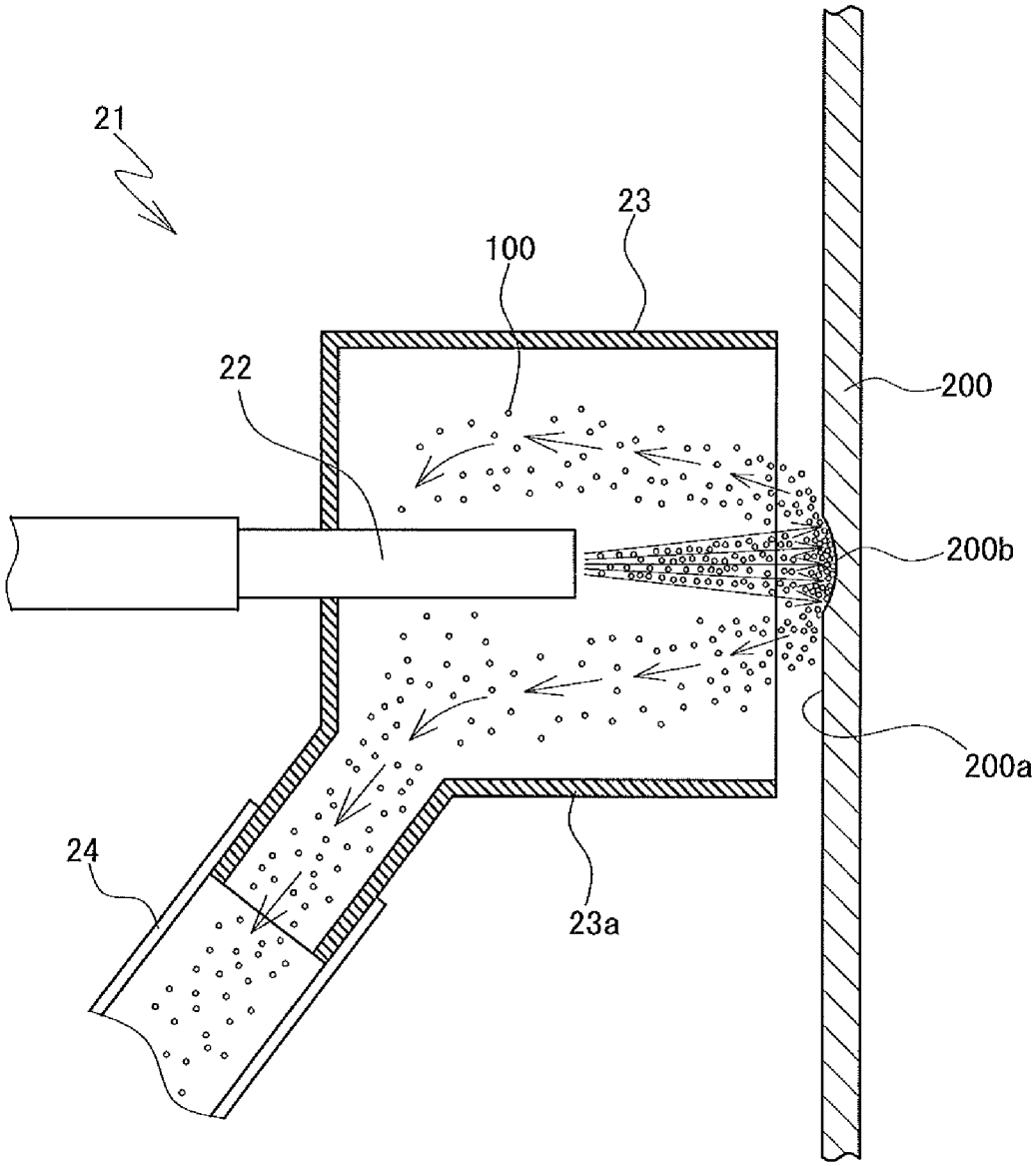
FIG. 2 PRIOR ART
FIG. 2 is a cross-sectional view showing a schematic configuration of a conventional blasting apparatus.

The conventional blasting apparatus 21 explained above in the Background Art referring to FIG. 2 has the configuration that the abrasive 100 is sucked from behind the nozzle case 23, that is, the configuration that the abrasive 100 is sucked in the direction opposite to the direction in which the abrasive 100 is blasted, so that if the suction power is increased, the striking power of strikes of the abrasive 100 on the surface 200*a* of the glass substrate 200 diminishes accordingly, which causes a problem that the blast processing is not sufficiently per formed. However, the blasting apparatus 1 according to the preferred embodiment of the present invention can solve this problem because it has the configuration that the abrasive 100 is sucked from behind the collecting case 11, not from behind the nozzle case 23.

Though the processing in a depth direction should be within an accuracy of several micrometers to several tens micrometers in forming the depressed portion 200*b* on the surface 200*a* of the glass substrate 200 having a thickness of about 0.7 mm by scraping a defect as described above off the glass substrate 200, the blasting apparatus 1 according to the preferred embodiment of the present invention is capable of maintaining such blast processing accuracy, and collecting the abrasive 100 while preventing the abrasive 100 from scattering around.

It is to be noted that the depressed portion 200*b* formed by scraping a defect off the glass substrate 200 is repaired such that a transparent ultraviolet cure resin, for example, is charged in an uncured state into the depressed portion 200*b* and then ultraviolet cured, and the raised portion of the resin is scraped preferably with a scraper to be planarized.

According to the blasting apparatus 1 described above, the scattering force of the abrasive 100 (the force of the abrasive 100 scattering around), which is blasted from the blasting nozzle 2, passes through the blast hole 10*b* of the cover 10 and strikes the surface 200*a* of the glass substrate 200, that is, the abrasive 100 used for blast processing in which the depressed portion 200*b* is formed by striking the surface 200*a* of the glass substrate 200 with the abrasive 100, is abated more as the abrasive 100 farther scatters around radially through the clearance 13 provided between the surface 10*a* of the cover 10 and the surface 200*a* of the glass substrate 200, and then the abrasive 100 is collected by suction from the collecting port 11*d*.

Therefore, the blasting apparatus 1 is capable of preventing the suction power from influencing the striking power of strikes of the abrasive 100 on the surface 200*a* of the glass substrate 200 even when the suction power from the collecting passage 11*c* is increased so that the abrasive 100, even having a small grain diameter, may be sufficiently sucked. In addition, the blasting apparatus 1 is capable of maintaining the blast processing accuracy, and collecting the abrasive 100 while preventing the abrasive 100 from scattering around.

Having the configuration that the open end 11*e* of the collecting case 11 is flush with the surface 10*a* of the cover 10, the blasting apparatus 1 allows the abrasive 100 to be sufficiently sucked and collected from the collecting passage 11*c* provided to the collecting case 11 even when the surface 10*a* of the cover 10 is brought closer to the surface 200*a* of the glass substrate 200, that is, even when the clearance 13 provided between the surface 10*a* of the cover 10 and the surface 200*a* of the glass substrate 200 is narrowed.

Having the configuration that the nozzle case 9 has the conical shape such that the side wall 9*a* of the nozzle case 9 expands toward the direction in which the abrasive 100 is blasted, and the collecting case 11 has the conical shape such that the side wall 11*a* of the collecting case 11 expands toward the direction in which the abrasive 100 is blasted, the blasting apparatus 1 allows the surface 10*a* of the cover 10 to obtain a size enough to abate the scattering force of the abrasive 100 that is used for blast processing the surface 200*a* of the glass substrate 200 and scatters, and allows a downsizing of the nozzle case 9 and the collecting case 11.

The foregoing descriptions of the preferred embodiments of the present invention have been presented for purposes of illustration and description with reference to the drawings. However, it is not intended to limit the present invention to the preferred embodiments, and modifications and variations are possible as long as they do not deviate from the principles of the present invention.

For example, though the blasting apparatus 1 described above has the configuration of a so-called suction blasting apparatus, the present invention is not limited to the embodiments described above and can be applied also to a pressure blasting apparatus or a centrifugal blasting apparatus.

Described above is the configuration that one suction port 11*f* is provided to the collecting case 11; however, two or more suction ports are preferably provided thereto in order to increase suction power to collect the abrasive 100.

In addition, described above is the configuration that the depressed portion 200*b* is formed on the surface 200*a* of the glass substrate 200 in the blast processing; however, the present invention is not limited to the embodiments described above, and the blasting apparatus according to the present invention can be used also for forming a groove or a through-hole in the glass substrate 200.

The invention claimed is:

1. A blasting apparatus comprising:

a blast nozzle arranged to blast an abrasive on a surface of work;

a nozzle case that forms an enclosure that surrounds the blasting nozzle, wherein the nozzle case includes a cover opposite the nozzle;

the cover comprising:

a surface for airflow alignment that is parallel to the work surface; and a blast hole through which the abrasive blasted from the blasting nozzle passes; and a collecting case that surrounds and is arranged to cover an outer surface of the nozzle case, and comprises a collecting passage disposed around the nozzle case, wherein the abrasive is collected by suction from the collecting passage, wherein the blasting apparatus is arranged to collect the abrasive, which is blasted from the blasting nozzle and strikes the work surface, from the collecting passage through a clearance provided between the surface of airflow alignment of the cover and the work surface.

2. The blasting apparatus according to claim 1, wherein the collecting case comprises an open end that is flush with the surface for airflow alignment of the cover.

3. The blasting apparatus according to claim 1, wherein the nozzle case has a conical shape such that a side wall of the nozzle case expands toward a direction in which the abrasive is blasted, and the collecting case has a conical shape such that a side wall of the collecting case expands toward the direction in which the abrasive is blasted.

4. A method for blast processing a surface of work with an abrasive blasted from a blasting nozzle of a blasting apparatus including; a blast nozzle arranged to blast an abrasive on a surface of work; a nozzle case that forms an enclosure that surrounds the blasting nozzle, wherein the nozzle case includes a cover opposite the nozzle; the cover including a surface or airflow alignment that is parallel to the work surface, and a blast hole through which the abrasive blasted from the blasting nozzle passes; and a collecting case that surrounds and is arranged to cover an outer surface of the nozzle case, and includes a collecting passage disposed around the nozzle case, the method comprising:

blasting the abrasive from the blasting nozzle on the work surface through the blast hole of the cover of the nozzle case that surrounds the blasting nozzle;

striking the work surface with the abrasive; and collecting, by suction from the collecting passage, the abrasive, which has passed through a clearance provided between the surface for airflow alignment of the cover and the work surface.

5. The method according to claim 4, wherein the collecting case comprises an open end that is flush with the surface for airflow alignment of the cover.

6. The method according to claim 4, wherein the nozzle case has a conical shape such that a side wall of the nozzle case expands toward a direction in which the abrasive is blasted, and the collecting case has a conical shape such that a side wall of the collecting case expands toward the direction in which the abrasive is blasted.

7. The method according to claim 4, further comprising the step of forming a depressed portion on the work surface by the use of the blast of the abrasive from the blasting nozzle.

8. The method according to claim 4, wherein the work comprises a glass substrate used for a display panel such as a liquid crystal display panel.

* * * * *